United States Patent [19]

Newman

[11] Patent Number: 5,024,380

[45] Date of Patent: Jun. 18, 1991

[54] METHOD AND APPARATUS FOR CONTINUOUS WELDED RAIL

[75] Inventor: H. Anthony Newman, Chesterton, Ind.

[73] Assignee: Bethlehem Steel Corporation, Bethlehem, Pa.

[21] Appl. No.: 461,552

[22] Filed: Jan. 5, 1990

[51] Int. Cl.[5] ..... E01B 23/00

[52] U.S. Cl. ..... 238/218; 29/402.12; 29/402.13; 238/10 R; 238/225

[58] Field of Search ..... 238/12, 218, 14.3, 10 R, 238/13, 122, 171, 218, 219, 220, 227, 228, 222, 225; 14/69.5; 29/402.01, 402.08, 402.11, 402.12, 402.13; 104/3

[56] References Cited

U.S. PATENT DOCUMENTS

| | | | |
|---|---|---|---|
| 210,705 | 12/1878 | Neff | 238/218 |
| 413,956 | 10/1889 | Moxham | 238/218 |
| 597,271 | 1/1898 | Edwards | 238/218 |
| 1,279,858 | 9/1918 | Goldsmith | 238/218 |
| 1,376,488 | 5/1921 | Wallinder | 238/218 |
| 2,539,650 | 1/1951 | Wirth | 238/218 |

FOREIGN PATENT DOCUMENTS

| | | | |
|---|---|---|---|
| 951449 | 10/1956 | Fed. Rep. of Germany | 238/218 |

*Primary Examiner*—Frank E. Werner
*Assistant Examiner*—Craig Slavin
*Attorney, Agent, or Firm*—Harold I. Masteller, Jr.

[57] ABSTRACT

A method and apparatus for replacing old trackwork rail with new continuous welded rail including a temporary bridge for transferring rolling stock from the oil rail onto the new rail.

8 Claims, 2 Drawing Sheets

10
11
12
13
13a
14
15
16
17
18
19
20
22
24
26
28
36
3
4
t

METHOD AND APPARATUS FOR CONTINUOUS WELDED RAIL

BACKGROUND OF THE INVENTION

This invention relates to a method and apparatus for replacing old bolted rails with new continuous welded rails. It relates particularly to replacing old rail with new continuous welded rails where rolling stock is parked along the old trackwork at such a location as to prevent further removal of old rail and placement of new continuous welded rail.

It is recognized by railroad and transit authorities that the using of continuous welded rail on trackwork is the most effective means of cutting rail maintenance costs and eliminating bolted joints. In coal mines continuous welded rail is used for the main haulage trackwork to reduce maintenance costs, but more importantly, continuous welded rail is used because of its smooth rolling surface which reduces spillage of product from the ore cars. And finally, in crane runways, the impact of mechanical rail joints on the surrounding equipment and building structures is eliminated through the use of continuous welded rail.

In view of the above advantages, it is becoming customary to replace old worn rail with new continuous welded rail. However, at times, the placement of the new continuous rail is interrupted when rolling stock is parked on the old trackwork where the old rail is being replaced with new continuous rail. Heretofore, under such circumstances, it has been the practice to cut the new continuous welded rail and manually electric arc weld the new rail to the old rail and allow the parked rolling stock to cross over onto the new rail section. The temporary welded splice is then cut and the remaining old rail is replaced with a new section of continuous welded rail and the two new continuous rail sections are joined together by any suitable means well-known in the art. As earlier stated, one of the advantages in using continuous welded rail is the elimination of rail joints, however, the current practice as described produces mechanical joints which tend to reduce the effectiveness of the continuous welded rail.

SUMMARY OF THE INVENTION

It is therefore an object of this invention to provide a temporary bridge means for transferring rolling stock from old rail onto newly laid continuous welded replacement rail. It is a further object of this invention to provide a method for the placement of new continuous rail where rolling stock is parked on the old trackway at a location which interrupts the removal of the old rail and placement of the new continuous welded rail.

It has been discovered that the foregoing objectives can be attained by providing a temporary bridge for transferring rolling stock from old rail onto newly laid continuous welded rail where the temporary bridge includes a first end portion supported upon, and fastened to, the rail head of the old rail, a second end portion supported upon the rail head of the newly laid continuous welded rail and attached to the rail support means with fastener plates and, an intermediate section extending between the first and second end portions of the temporary bridge the intermediate portion spanning an open distance between the old rail and newly laid continuous welded rail.

DESCRIPTION OF THE PREFERRED EMBODIMENT

Figures 1, 2, 3, 4, 5:
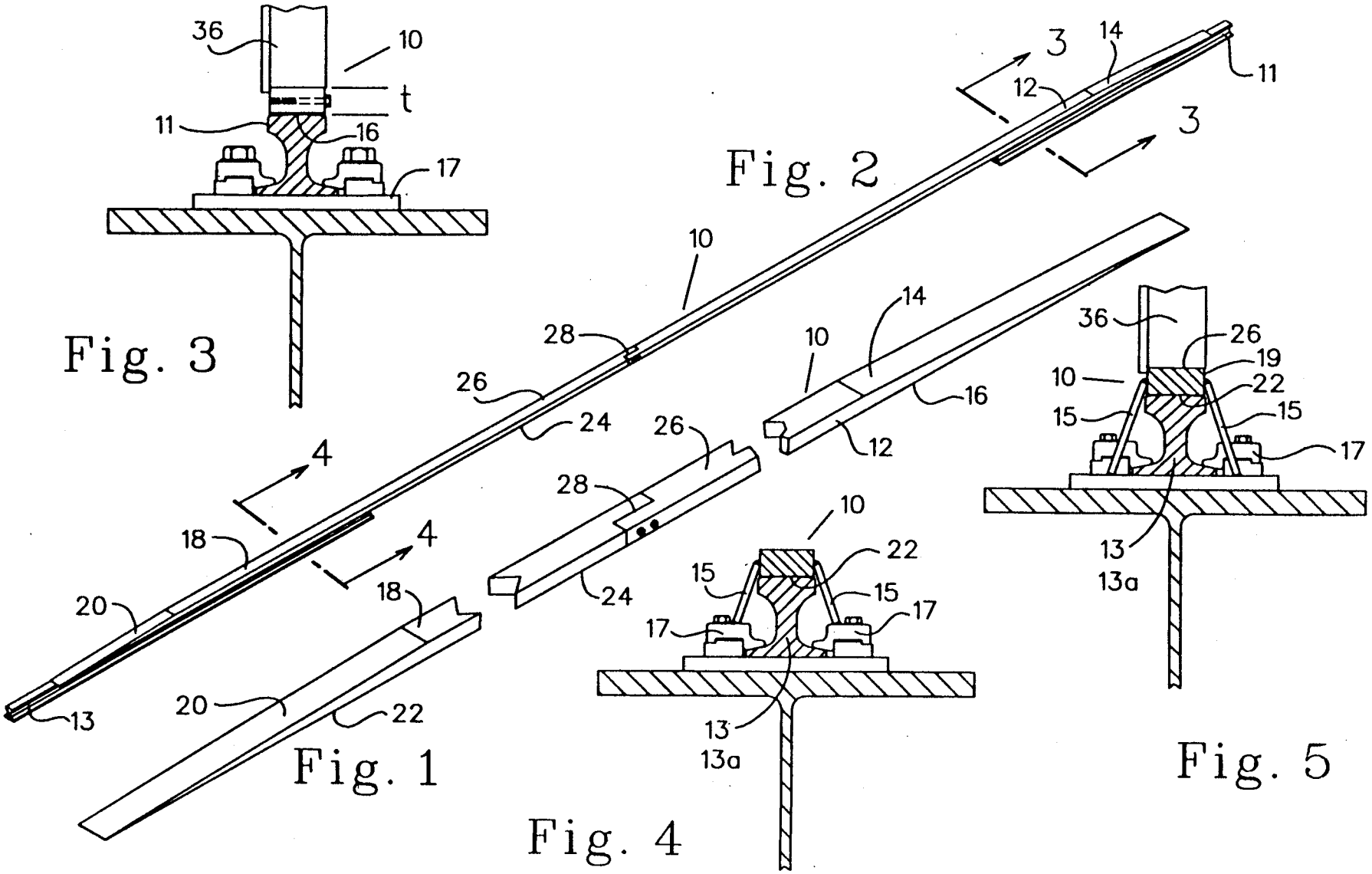
FIG. 1 is a fragmentary isometric view of the temporary bridge of the invention.
FIG. 2 is an isometric view showing a temporary bridge supported upon the rail head of old rail which is to be replaced and supported upon the rail head of newly laid continuous welded rail.
FIG. 3 is a cross-sectional view taken along the lines 3—3 of FIG. 2 showing a temporary bridge attached to the rail head of an old rail.
FIG. 4 is a cross-sectional view taken along the lines 4—4 of FIG. 2 showing a temporary bridge supported upon the rail head of newly laid continuous welded rail and attached to support means for the new continuous welded rail.
FIG. 5 is a cross-sectional view similar to FIG. 4 showing an alternate means for attaching a temporary bridge to support means for the new continuous welded rail.

Referring to FIGS. 1 through 5 of the drawings, the preferred embodiment of the temporary bridge apparatus 10 is shown comprising a first end portion 12 including an inclined rolling surface 14 and a base 16, a second end portion 18 including an inclined rolling surface 20 and a base 22 and, an intermediate portion 24 extending from the first end portion 12 to the second end portion 18 including a substantially horizontal rolling surface 26. As shown in FIG. 3, the depth "t" of the temporary bridge 10 is large enough to raise the rolling stock to an elevation sufficient to prevent damage to the new continuous welded rail by the wheels 36 of the vehicle as the rolling stock transfers from the old rail 11 onto the new continuous welded rail 13. For convenience, the temporary bridge is shown to include two substantially equal length sections joined together with a straight splice joint 28 and fasteners. It should be understood, however, that the temporary bridge could also be constructed as a single unit having no joints.

Base 16 is supported upon the rail head of the old rail 11 and the first end portion 12 of the temporary bridge is attached to the old rail 11 by welding or other means. Base 22 is supported upon the rail head of the new continuous welded rail 13 and support plates 15 are used to attach the end second portion 18 of the temporary bridge to the rail support means 17 by welding or other means. Support plates 15 are attached to the sides 19 of the temporary bridge at a distance below the horizontal rolling surface 26 which is great enough to prevent interference between the outside diameter of the wheel flanges of rolling stock and the support plates 15. Support plates 15 also prevent the need for attaching the second end portion 18, of the temporary bridge 10, directly to the new continuous welded rail.

As shown in FIGS. 6 through 9 of the drawings, during rerailing operations, where removal of old rail and placement of new continuous welded rail is interrupted due to rolling stock 30 parked on the trackwork 11, the old rail is cut and removed up to a location 31 near the parked rolling stock. The new continuous welded rail 13 is then placed along the rail centerline 38 and, as shown in FIG. 3, is secured by rail clips 17 or other fastening means, along Section 13*a* of the new rail up to a location near the remaining old rail 11 on which the rolling stock is parked. The remaining unsecured Section 13*b*, of new continuous welded rail 13, is then bent to extend substantially parallel to either the left or right side of the remaining old rail 11.

Figures 6, 7, 8, 9:
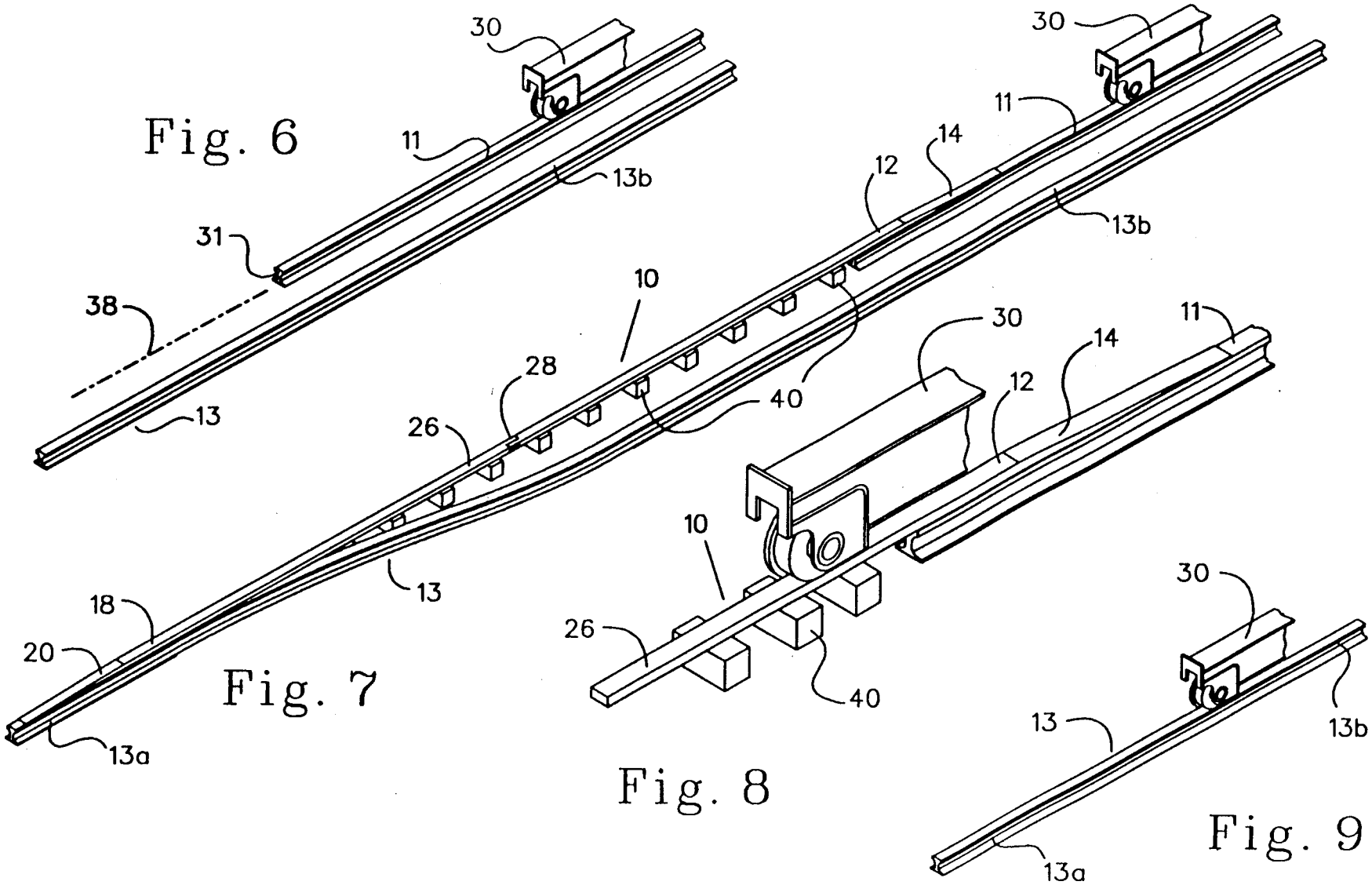
FIG. 6 is a isometric view showing a new section of continuous rail in position for placement where rolling stock is parked on old trackwork.
FIG. 7 is an isometric view showing a temporary bridge in position upon both a newly laid section of new continuous welded rail and a remaining section of old rail.
FIG. 8 is an isometric view showing rolling stock being transferred from old rail to new continuous welded rail.
FIG. 9 is an isometric view showing new continuous welded rail in place and the old rail removed.

Referring to FIG. 7 of the drawings, the temporary bridge 10, is placed upon the rail heads of both the remaining old rail 11 and the secured Section 13*a* of the new continuous welded rail 13 and the temporary bridge 10 spans the open distance between the old rail 11 and Section 13*b* of the new rail. Base 16, of the first end portion 12 of temporary bridge 10, is attached to the rail head of remaining old rail 11 by welding or other means, as shown in FIG. 3, and base 22, of the second end portion 18 of the temporary bridge 10, is supported upon the rail head of the secured Section 13*a* of the new continuous welded rail 13 and is attached to the rail support means 17 by support plates 15 as shown in FIGS. 4 and 5.

After the temporary bridge 10 has been sufficiently secured to the remaining old rail 11 and rail support means 17, support blocks 40 are positioned beneath the intermediate portion 24 of bridge 10 along the unsupported open span between rail Sections 11 and 13*b*. With all support blocks 40 in place the parked rolling stock 30 is then able to transfer from the old rail 11, up the inclined rolling surface 14 of the temporary bridge, along the horizontal rolling surface 26, as shown in FIG. 8, and down the inclined rolling surface 20 onto the fastened Section 13*a* of the new continuous welded rail 13.

With the rolling stock 30 transferred onto Section 13*a* of the new rail 13, the temporary bridge 10, all support plates 15 and support blocks 40 are removed. The remaining old rail 11 is unfastened and removed from the trackway and the unsupported Section 13*b* of the new continuous rail 13 is realigned into position along the rail centerline 38. Rail Section 13*b* of the new rail 13 is then fastened using rail clips or other fastening means and the rerailing operations can again proceed as before the interruption by parked rolling stock.

Although the drawings, and epically FIGS. 3–5, show trackwork which is typically used for overhead crane runways, it should be understood that the scope of the invention is meant to include all types of trackwork well-known in the art and other embodiments and changes may be made without departing from the invention as set forth.

I claim:

1. A method of replacing old rail with new continuous welded rail where rolling stock is parked on the trackway at a location which prevents further removal of old rail and placement of new rail said method comprising the steps:

a) removing the old rail up to a location near the parked rolling stock, b) placing new continuous welded rail along the trackwork where the said old rail has been removed and fastening the said new continuous welded rail to the trackwork up to a location near said parked rolling stock, c) bending the remaining unfastened portion of said new continuous welded rail to extend substantially parallel along side of the remaining old worn rail on which said rolling stock is parked, d) providing a temporary bridge to span the distance between the said remaining old rail and new fastened continuous welded rail, e) transferring said parked rolling stock from said remaining old rail, across said temporary bridge and onto said fastened new continuous rail, f) removing said temporary bridge, g) removing remaining said old worn rail, and h) bending said remaining unfastened new continuous welded rail into alignment with, and along the centerline of, said fastened new continuous welded rail, and fastening said remaining unfastened new continuous welded rail to the said trackwork.

2. The method of claim 1 in which the temporary bridge (d) comprises:

a) a first end portion supported upon, and fastened to, the rail head of the old rail, said first end portion including an inclined rolling surface, b) a second end portion supported upon the rail head of the new rail and fastened to the support means, said second end portion including an inclined rolling surface, and c) an intermediate portion extending between said first end portion and said second end portion said intermediate portion including a rolling surface.

3. The method of claim 2 in which the second end portion (b) of said temporary bridge includes at least one fastener plate extending from said temporary bridge to the rail support means said fastener plate having one end attached to the rail support means and the other end attached to the temporary bridge at a location to prevent interference with rolling stock wheels.

4. The method of claim 2 in which one end of the fastener plate is attached to a rail clip assembly.

5. The method of claim 1 in which the intermediate Section (c) of said temporary bridge comprises at least one splice joint.

6. The method of claim 1 in which the first end portion (a) is welded to the rail head.

7. The method of claim 1 in which the intermediate portion (c) includes temporary support blocks.

8. A temporary bridge for transferring rolling stock from old rail onto new rail during rerailing of a trackway said temporary bridge comprising:

a) a first end portion supported upon, and fastened to the rail head of the old rail, said first end portion including an inclined rolling surface, b) a second end portion supported upon the rail head of the new rail and fastened to a clip assembly rail support means, said second end portion including an inclined rolling surface, c) an intermediate portion extending between said first end portion and said second end portion said intermediate portion including a rolling surface, and d) at least one fastener plate extending from said second end portion (b) of said temporary bridge to said rail support means said fastener plate having one end attached to said rail support means and the other end attached to the temporary bridge at a location to prevent interference with the rolling stock wheels.

* * * * *